US008398220B2

(12) United States Patent
Uchida et al.

(10) Patent No.: US 8,398,220 B2
(45) Date of Patent: Mar. 19, 2013

(54) LIQUID CONTAINER AND IMAGE FORMING APPARATUS

(75) Inventors: Takuya Uchida, Tokyo (JP); Hiroyuki Moriya, Kanagawa (JP); Hideki Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 370 days.

(21) Appl. No.: 12/878,259

(22) Filed: Sep. 9, 2010

(65) Prior Publication Data

US 2011/0063384 A1 Mar. 17, 2011

(30) Foreign Application Priority Data

Sep. 14, 2009 (JP) ..... 2009-212527

(51) Int. Cl.
*B41J 2/175* (2006.01)

(52) U.S. Cl. ..... 347/86

(58) Field of Classification Search ..... 347/84, 347/85, 86, 87
See application file for complete search history.

(56) References Cited

U.S. PATENT DOCUMENTS

| | | | | |
|---|---|---|---|---|
| 6,908,180 | B2 * | 6/2005 | Dietl | 347/85 |
| 6,959,984 | B2 * | 11/2005 | Ogura et al. | 347/86 |
| 7,954,662 | B2 * | 6/2011 | Ogura et al. | 220/723 |
| 8,272,704 | B2 * | 9/2012 | Gilson et al. | 347/7 |

FOREIGN PATENT DOCUMENTS

| | | |
|---|---|---|
| JP | 2007-130979 | 5/2007 |
| JP | 2009-23251 | 2/2009 |
| WO | WO2009/014224 | 1/2009 |

* cited by examiner

*Primary Examiner* — Anh T. N. Vo
(74) *Attorney, Agent, or Firm* — Cooper & Dunham LLP

(57) ABSTRACT

A disclosed liquid container containing liquid to be supplied to a liquid discharge head includes a container main body defining a liquid containing section and including an opening section formed in one surface of the container main body, the opening section including an opening; and a film-like flexible member sealing the opening section of the container main body. Further, the film-like flexible member is joined with a joint section formed on the opening section of the container main body in a state where the film-like flexible member is bent, and a concave-convex structure is formed in the circumferential direction of the joint section.

9 Claims, 19 Drawing Sheets

LIQUID CONTAINER AND IMAGE FORMING APPARATUS

CROSS-REFERENCE TO RELATED APPLICATIONS

The present application claims priority under 35 U.S.C §119 based on Japanese Patent Application No. 2009-212527 filed Sep. 14, 2009, the entire contents of which are hereby incorporated herein by reference.

BACKGROUND OF THE INVENTION

1. Field of the Invention

The present invention generally relates to a liquid container and an image forming apparatus, and more particularly to an image forming apparatus having a recording head discharging liquid droplets and a liquid container used in the image forming apparatus.

2. Description of the Related Art

As an image forming apparatus such as a printer, a facsimile machine, a copier, a plotter, a multifunction peripheral thereof and the like, there has been known an image forming apparatus using a recording head having a liquid discharge head discharging liquid droplets. In the image forming apparatus, an image is formed by adhering the discharged liquid onto a medium while the medium is fed. Hereinafter, the term "medium" may be called "sheet". However, the material of the "sheet" is not limited to a specific material. Herein, the term "sheet" is collectively used to refer to any material called a medium to be recorded on, a recording medium, a transfer material, recording paper, recording sheet, and the like. Further, herein, the term "image forming" is collectively used to refer to recording, printing, imaging, typing and the like.

Further, herein, the term "image forming apparatus" refers to an apparatus forming an image by discharging liquid onto a medium including paper, thread, fiber, textile, leather, metal, plastic, glass, wood, ceramic and the like. The term "image forming" refers to not only forming a meaningful image such as characters, figures, and the like on a medium but also forming a meaningless image such as a pattern and the like on a medium (including simply discharging droplets onto a medium). Further, the term "ink" is collectively used to refer to not only any material called "ink" but also any liquid for forming an image, the liquid including a DNA sample, resist, a pattern material, resin and the like. Further, the term "image" is not limited to a planar image. The image includes an image added to a three-dimensional object and an image formed as a three-dimensional model based on a solid model.

As an image forming apparatus (hereinafter may be referred to as an inkjet recording apparatus) as described above, there is a known apparatus. In the known apparatus, a sub tank (a.k.a. ink tank and buffer tank) supplying ink to the recording head is mounted on a carriage, a main ink cartridge (which may also be called a "main tank") is disposed on the apparatus main body side, and the ink is supplied from the ink cartridge on the apparatus main body side to the sub tank. In another known apparatus, an ink cartridge serving as a liquid container can be replaced along with the recording head.

Japanese Patent Application Publication No. 2007-130979 discloses a sub tank including a container main body (tank main body) defining an ink containing section. The container main body includes an opening section having an opening. A flexible film-like member is joined by means of adhesion or welding to the opening section so that the opening is sealed by the flexible film-like member. In this case, a spring as an elastic member is disposed between the tank main body and the film-like member within the ink containing section so as to bias the film-like member outward. By having the film-like member and the elastic member, a negative pressure generation mechanism is provided.

Japanese Patent Application Publication No. 2009-023251 discloses a tank case having one surface made of a flexible film. A pressure chamber is formed in the tank case, and there is an air chamber communicating with the pressure chamber via an opening section. Further, there is an air-liquid separation film disposed at the opening section, and there is a biasing member biasing the flexible film to the outer direction of the tank case. Further, there is a valve which opens/closes a liquid introducing inlet to introduce the liquid into the pressure chamber based on the movement of the flexible film.

In the liquid container having the container main body (tank case) having the opening section sealed by the film-like flexible member as described above, it may be required for the flexible member to be stably deformed while the liquid is consumed or refilled. On the other hand, there is another demand for reducing the differences in deforming manner depending on the types of liquid filled in the liquid container.

SUMMARY OF THE INVENTION

The present invention is made in light of the above circumstances, and may allow a film-like flexible member forming one surface of the container main body to be stably moved upon being deformed.

According to an aspect of the present invention, a liquid container containing liquid to be supplied to a liquid discharge head is provided. The liquid container includes a container main body defining a liquid containing section and including an opening section formed in one surface of the container main body, the opening section including an opening, and a film-like flexible member sealing the opening section of the container main body. Further, the film-like flexible member is joined with a joint section formed on the opening section of the container main body in a state where the film-like flexible member is bent, and a concave-convex structure is formed in the circumferential direction of the joint section.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the following, embodiments of the present invention are described with reference to the accompanying drawings.

First, a liquid discharge head unit having a liquid container according to a first embodiment of the present invention is described with reference to FIGS. 1 and 2.

Figure 1:
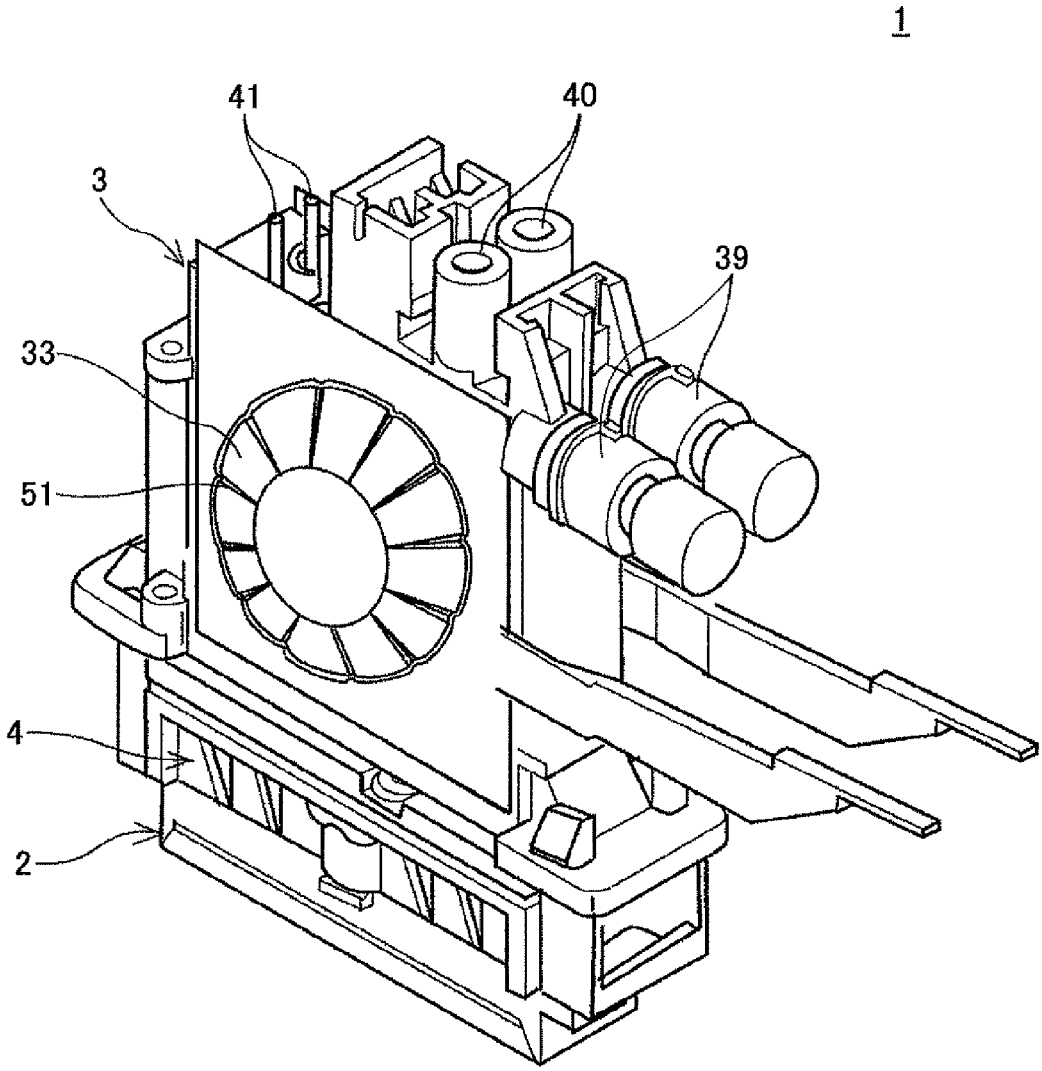
FIG. 1 is an oblique view illustrating a liquid discharge head unit including a sub tank as a liquid container according to a first embodiment of the present invention.
Figure 2:
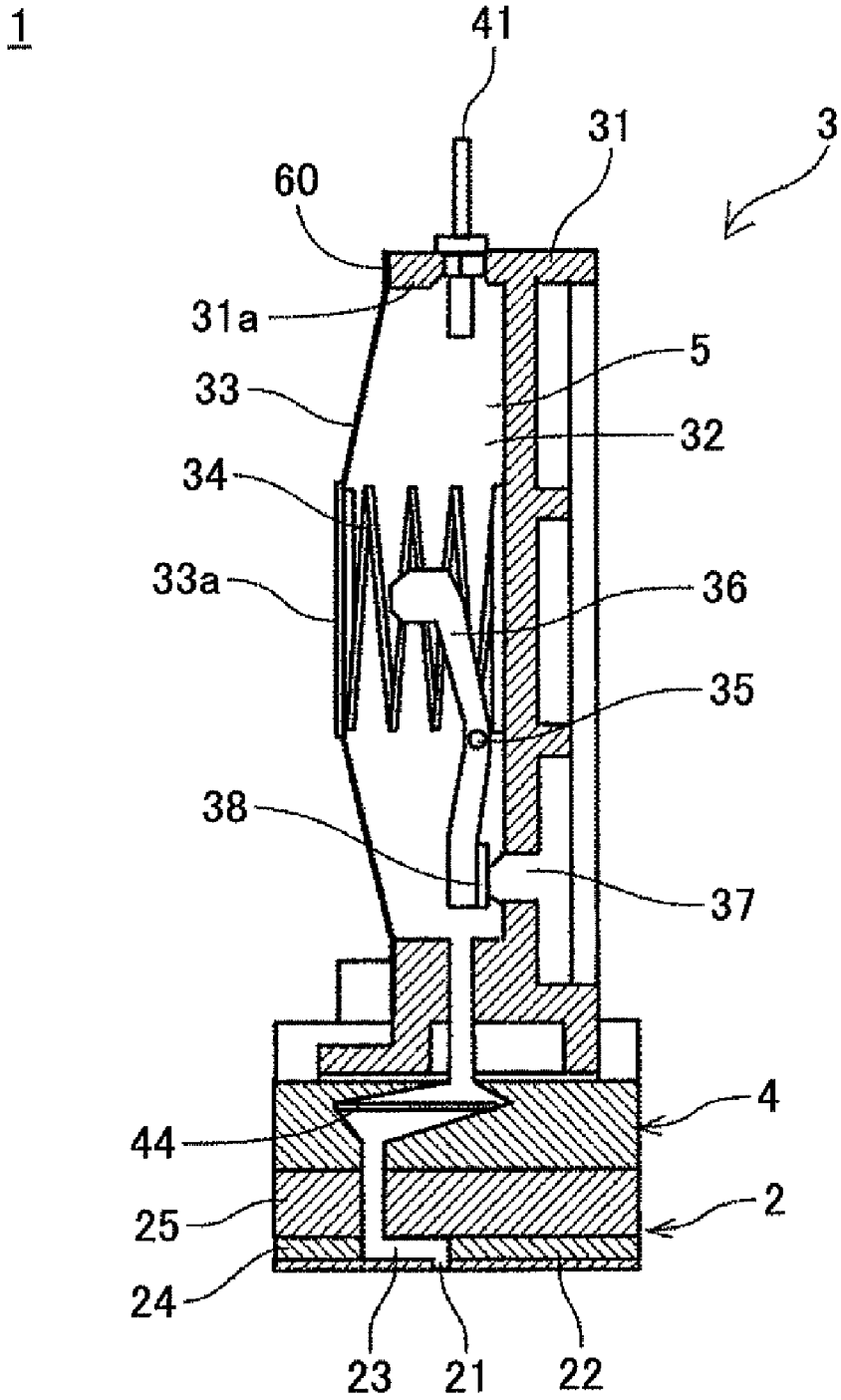
FIG. 2 is a cross-sectional side view of the sub tank in FIG. 1.

FIG. 1 is an oblique view illustrating a liquid discharge head unit having a sub tank as a liquid container according to the first embodiment of the present invention;

FIG. 2 is a cross-sectional side view of the sub tank of FIG. 1;

As illustrated in FIG. 1, a liquid discharge head unit 1 includes a liquid discharge head 2, a sub tank 3, and a filter unit 4. The liquid discharge head 2 discharges liquid droplets. The sub tank 3 serves as the liquid container temporarily storing ink 5 to be supplied to the liquid discharge head 2. The liquid discharge head unit 1 integrates the liquid discharge head 2, the sub tank 3, and the filter unit 4 disposed between the liquid discharge head 2 and the sub tank 3. The liquid discharge head unit 1 may integrate the liquid discharge head 2 and the sub tank 3 on a steady basis. However, the liquid discharge head unit 1 may integrate the liquid discharge head 2 and the sub tank 3 only when the liquid discharge head unit 1 is used. Herein, it is assumed that the former configuration is employed.

As illustrated in FIG. 2, the liquid discharge head 2 includes a nozzle plate 22, a flow path plate 24, a frame member 25, and actuator means (not shown). The nozzle plate 22 forms a nozzle 21 through which liquid droplets are discharged. The flow path plate 24 forms a liquid chamber 23 which is in communication with the nozzle 21. The frame member 25 forms, for example, a common liquid chamber though which ink is supplied to the liquid chambers 23. The actuator means increases the pressure of the ink in the liquid chambers 23.

Further, the sub tank 3 includes a container main body (hereinafter may be referred to as a "tank case") 31, a film-like flexible member (hereinafter may be referred to as a "flexible film") 33, a spring 34, and a negative pressure adjusting valve actuating lever 36. The tank case 31 includes an opening section 31*a* formed on one surface of the tank case 31. The opening section 31*a* has an opening and is sealed by the flexible film 33 formed in a dome shape. The tank case 31 and the flexible film 33 collectively define an ink containing section 32. Further, a joint section 60 is formed on the opening section 31*a* of the tank case 31. The flexible film 33 is joined with the joint section 60 on the opening section 31*a* of the tank case 31 by means of welding (or adhesion).

Further, the spring 34 serving as an elastic member is disposed between the tank case 31 and a distal end surface 33*a* of the flexible film 33 in the ink containing section 32, so that the flexible film 33 is biased outward by the spring 34. Further, the negative pressure adjusting valve actuating lever 36 is also disposed in the ink containing section 32, and is swingably supported by a fulcrum point 35. The negative pressure adjusting valve actuating lever 36 includes a negative pressure adjusting valve 38 which opens/closes an ink supply opening 37 through which ink is supplied into the ink containing section 32.

Further, as illustrated in FIG. 1, there is an opening mechanism 39 disposed on an upper side of the tank case 31. The opening mechanism 39 opens the ink containing section 32 to atmospheric air. Further, there is also a tube connecting section 40 disposed on the upper side of the tank case 31. The tube connecting section 40 is used to connect an ink supply tube through which the ink containing section 32 is in communication with a main tank (not shown). Further, there are two detection electrodes 41 disposed on the upper side of the tank case 31. Those two detection electrodes 41 are used to detect an amount of the ink in the ink containing section 32.

In this sub tank 3, when air or ink is discharged from the ink containing section 32 filled with ink, the volume of the ink containing section 32 changes. In response to the change of the volume of the ink containing section 32, the flexible film 33 is accordingly hollowed (deformed). Due to this hollow (deformation) of the flexible film 33, the spring 34 disposed in the ink containing section 32 is compressed, thereby generating a negative pressure.

As illustrated in FIG. 2, in the filter unit 4, there is a filter 44 to remove impurities from the ink supplied from the sub tank 3 to the liquid discharge head 2.

Figure 3B:
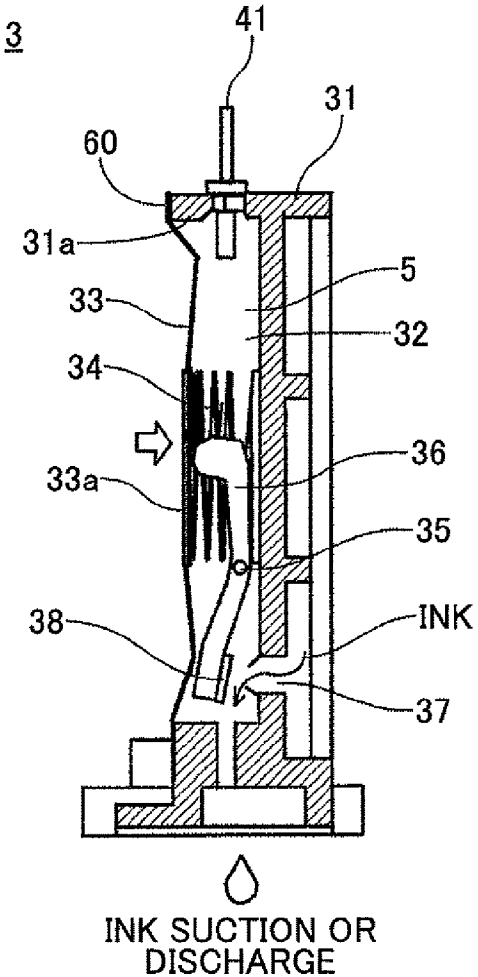
FIGS. 3A and 3B are cross-sectional side views of the sub tank when a flexible film of the sub tank moves and changes its shape.
Figure 3A:
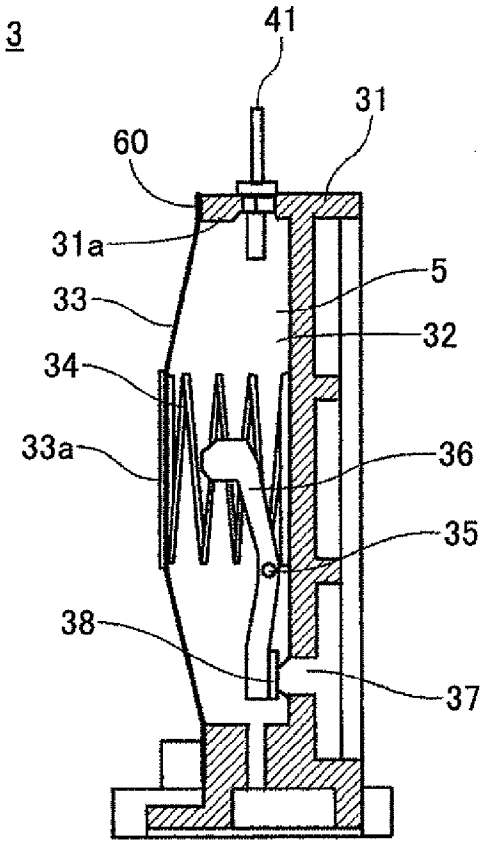
Figure 4:
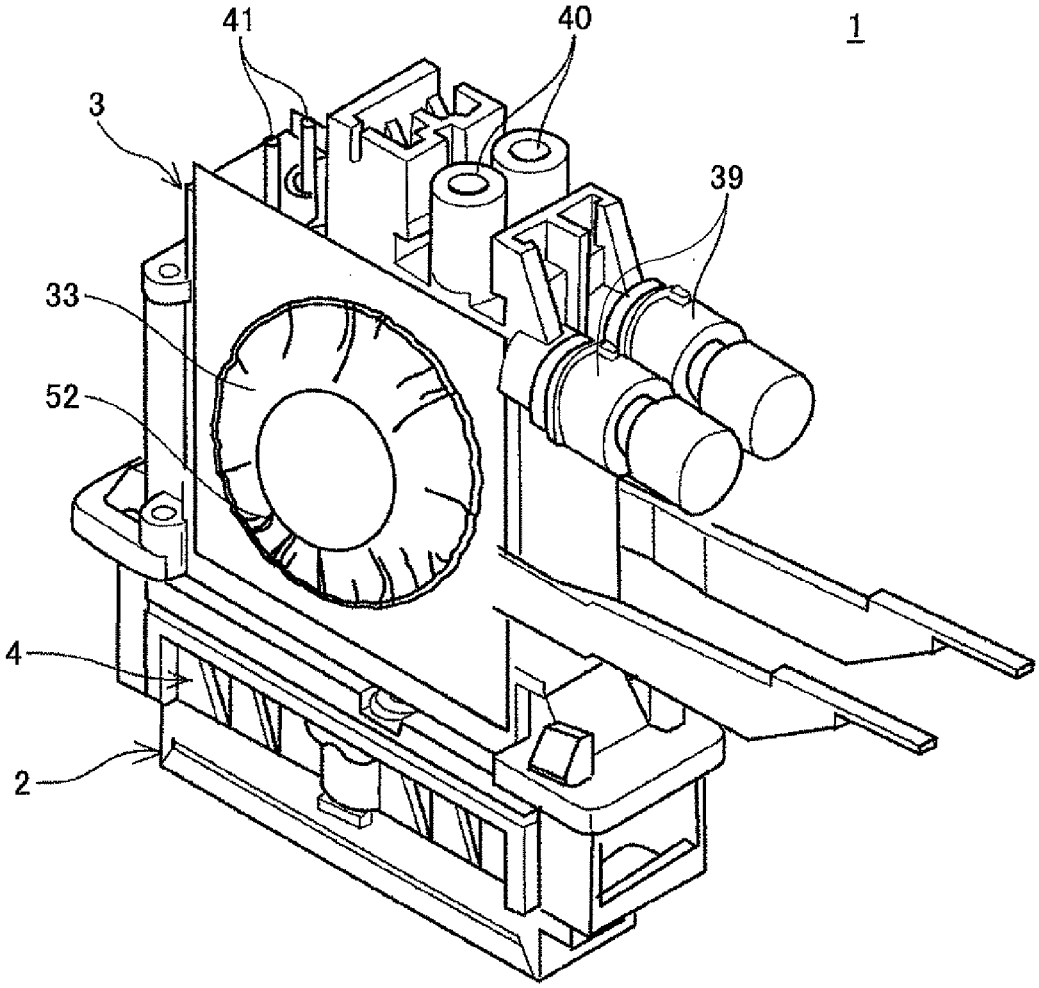
FIG. 4 is an oblique view illustrating the liquid discharge head unit when wrinkles are formed in the flexible film.

Next, how the flexible film is deformed in a conventional sub tank is described with reference to FIGS. 3A, 3B, and 4. FIGS. 3A and 3B are cross-sectional side views of a conventional sub tank. FIG. 4 is an oblique view illustrating the liquid discharge head unit when wrinkles are formed in the flexible film.

To fill ink in the ink containing section 32, first, the opening mechanism 39 is used to open the ink containing section 32 to atmospheric air, and ink is supplied from the main tank (not shown) into the ink containing section 32 of the sub tank 3. As a result, an ink surface is raised. When the ink surface is detected by the detection electrodes 41 serving as a fluid (ink) surface detection sensor, the supplying of ink is stopped and the opening mechanism 39 is closed to finish supplying the ink (ink refill).

In this case, a shape of the flexible film 33 welded in a dome shape is expanded (swollen) as illustrated in FIG. 3A because the flexible film 33 is biased outward by the spring 34. However, when ink is suctioned or discharged from the liquid discharge head 2, the volume of the ink containing section 32 is reduced. Then, as illustrated in FIG. 3B, the flexible film 33 is hollowed (deformed). However, even in this case, the flexible film 33 is biased outward due to the biasing force of the spring 34. Due to the biasing force, a negative pressure is generated. Then, when the distal end surface 33*a* of the flexible film 33 is in contact with the negative pressure adjusting valve actuating lever 36, the negative pressure adjusting valve actuating lever 36 is swung so that the ink supply opening 37 is opened by the negative pressure adjusting valve 38 to supply ink into the ink containing section 32. When ink is supplied and the negative pressure in the ink containing section 32 is decreased, the flexible film 33 is expanded and the distal end surface 33*a* of the flexible film 33 is separated from the negative pressure adjusting valve actuating lever 36 to close the ink supply opening 37 by the negative pressure adjusting valve 38. The series of the processes are repeated to control (maintain) the negative pressure in the ink containing section 32 to be constant.

FIG. 4 shows wrinkles 52 formed when the flexible film 33 is joined (thermally welded) with the joint section 60 in a state where the surface of the flexible film 33 is bent, the joint section 60 being formed along the peripheral part of the opening section 31*a*. When the flexible film 33 is started to be bent (deformed), a part where fewer wrinkles 52 are in the flexible film 33 starts bending first (as schematically illustrated in FIG. 4, the distal side having fewer wrinkles 52 is largely bent). This phenomenon occurs because the part having a concave-convex structure due to the wrinkles 52 has more rigidity. However, if the wrinkles 52 are irregularly formed, the bending (deformation) patterns of the flexible films 33 may differ among sub tanks 3, thereby increasing variations (different characteristics) among the sub tanks 3.

Figure 5:
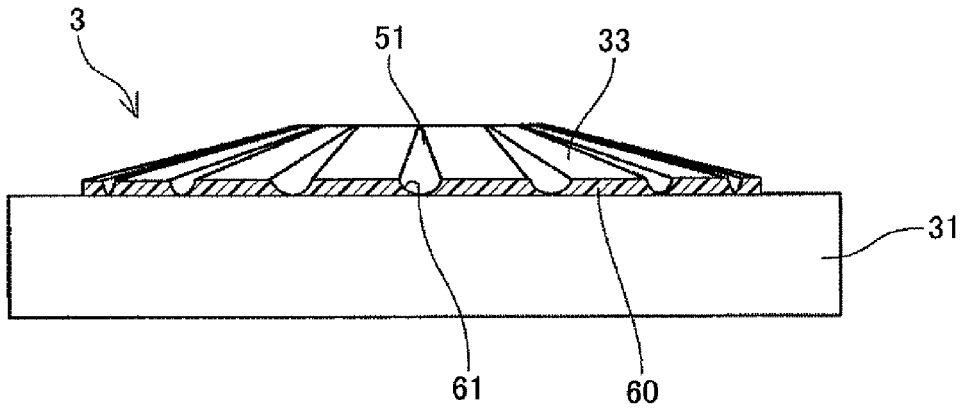
FIG. 5 is a cross-sectional side view illustrating an example of a joint section where the flexible film is to be joined according to the first embodiment of the present invention.
Figure 6:
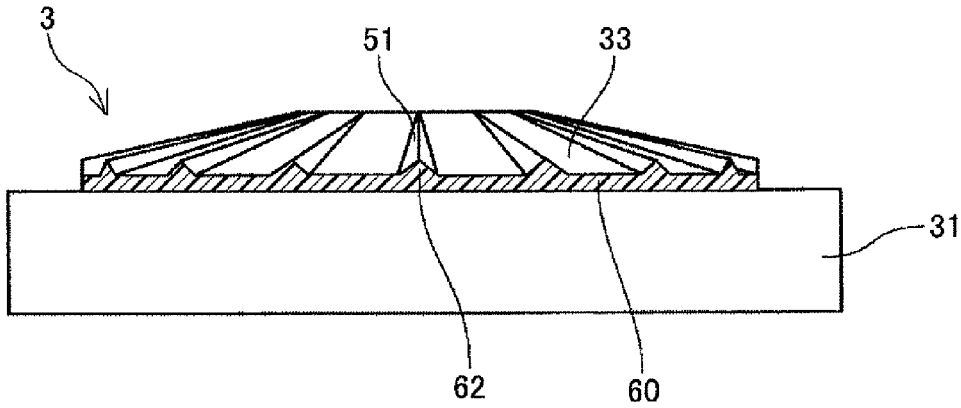
FIG. 6 is a cross-sectional side view illustrating another example of the joint section according to the first embodiment of the present invention.

Next, examples of the joint section 60 formed on the opening section 31*a* of the tank case 31 in the sub tank 3 according to the first embodiment of the present invention are described with reference to FIGS. 5 and 6. As described above, the flexible film 33 is joined with the joint section 60. FIGS. 5 and 6 are cross-sectional side views of the joint sections 60 formed on the opening section 31*a* in its circumferential direction. The flexible films 33 are to be joined with the joint sections 60 on the opening section 31*a* of the tank case 31 in the sub tank 3.

More specifically, FIG. 5 illustrates a case where concave parts 61 are formed in the circumferential direction of the joint section 60 through which the flexible film 33 is joined with the tank case 31. By forming the concave parts 61, a concave-convex structure(s) is (are) formed in the circumferential direction of the joint section 60 through which the flexible film 33 is joined with the tank case 31.

Figure 7:
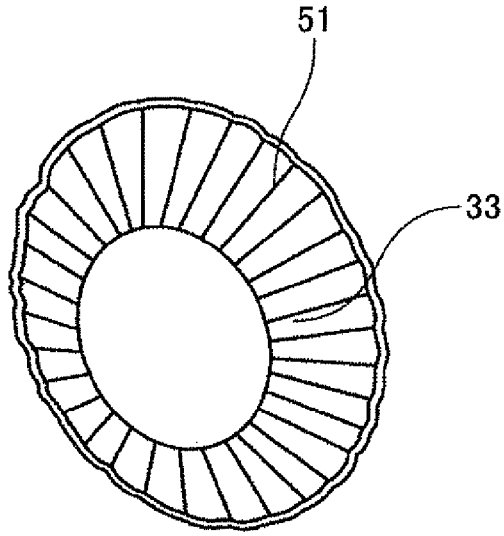
FIG. 7 is an oblique view of the flexible film where regular wrinkles are formed in the flexible film.
Figure 8:
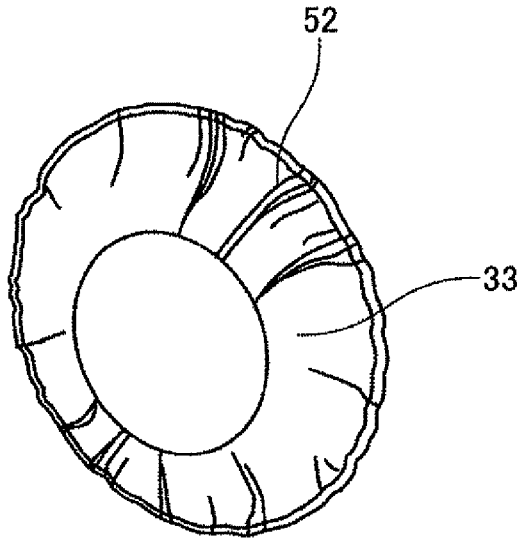
FIG. 8 is an oblique view of the flexible film where irregular wrinkles formed in the flexible film.

When the concave-convex structure is formed in the circumferential direction of the joint section 60 where the flexible film 33 is joined with the tank case 31, and then the flexible film 33 is weld-joined with the joint section 60, regular wrinkles 51 as illustrated in FIG. 7 are formed in the flexible film 33. On the other hand, as a comparative example, a case is considered where the joint section 60 through which the flexible film 33 is joined with the tank case 31 is formed in a manner such that the joint section 60 has a flat surface, and the flexible film 33 is joined by means of welding with the joint section 60. In this case, irregular wrinkles 52 as illustrated in FIG. 8 are formed in the flexible film 33.

Figure 9:
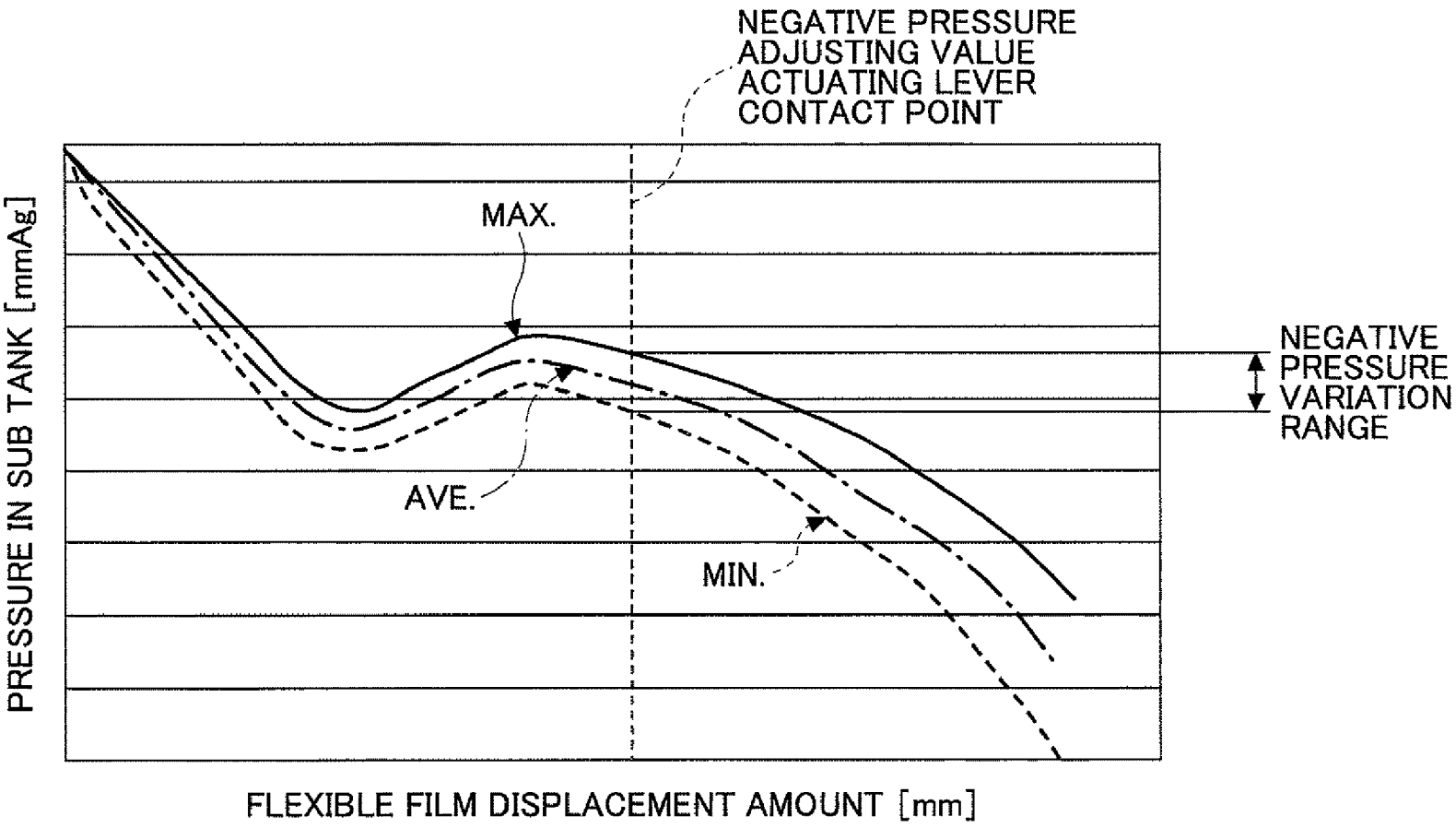
FIG. 9 is a graph illustrating a relationship between displacement amounts of the flexible films and an internal pressure of the sub tank as the liquid container according to the first embodiment of the present invention.

As a comparison between the examples (e.g., in FIG. 7) and the comparative example (FIG. 8), a relationship between the negative pressure and a displacement value (deformed amount) of the flexible film 33 is measured for plural sub tanks 3 of the examples and plural sub tanks 3 of the comparative examples. FIG. 9 illustrates a measurement result of the relationship in the sub tanks 3 of the examples. On the other hand, FIG. 10 illustrates a measurement result of the relationship in the sub tanks 3 of the comparative example.

Figure 10:
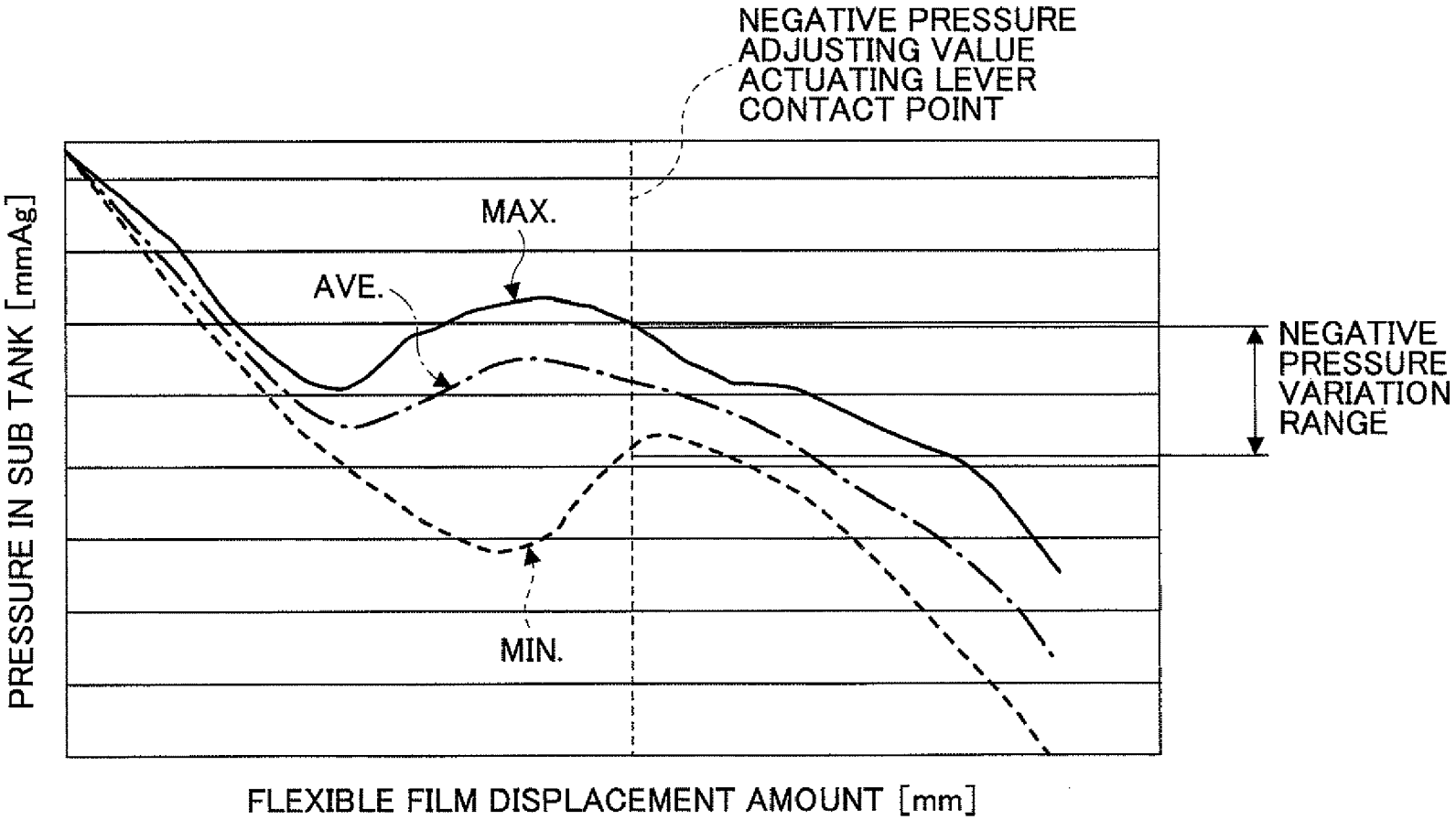
FIG. 10 is a graph illustrating a relationship between displacement amounts of the flexible films and an internal pressure of a conventional sub tank as a comparative example.

As the results of FIGS. 9 and 10 indicate, the displacement amounts of the flexible films 33 due to the internal pressure change in the sub tanks 3 of the examples are more stable than those of the comparative example. Therefore, when the joint section 60 as illustrated in FIG. 5 or 6 is used, it may become possible to reduce the differences (variations) of the internal pressures (negative pressures) of the sub tanks 3 when, for example, the negative pressure adjusting valve actuating lever 36 is operated when compared with a case where the joint section 60 has a flat surface (in the comparative example).

To stabilize the printing quality when an image is formed using a liquid discharge head as a recording head, it is necessary to stabilize meniscuses of nozzles of the liquid discharge head. To that end, it may be important to stabilize the displacement characteristics of a damper film disposed in an ink supply path, an ink storage section or the like restricting the vibration of ink in the sub tank and a flexible film of a negative pressure generation mechanism.

In the cases of examples in FIGS. 5 and 6, the regular wrinkles 51 are formed because the flexible films 33 are joined by means of welding with the joint sections 60 in a state where the surfaces of the flexible films 33 are bent. Further, when the flexible film 33 starts bending (deforming), the part where fewer wrinkles are formed in the flexible film 33 starts bending first. This occurs because the part having more wrinkles has more rigidity.

However, in the case where the flexible films 33 start bending, when the wrinkles are irregular wrinkles 52 (irregularly formed) as in the comparative example (FIG. 8), the flexible films 33 may be bent in different manners among the sub tanks 3, thereby increasing the difference in the negative pressure characteristics among the sub tanks 3.

On the other hand, when the wrinkles are regular wrinkles 51, the difference in the bending (deformation) of the flexible films 33 among the sub tanks 3 may be reduced. As a result, it may become possible to obtain the negative pressure characteristics having less variation among the sub tanks 3.

Next, a sub tank as a liquid container according to a second embodiment of the present invention is described with reference to FIGS. 11A and 11B.

Figure 11A:
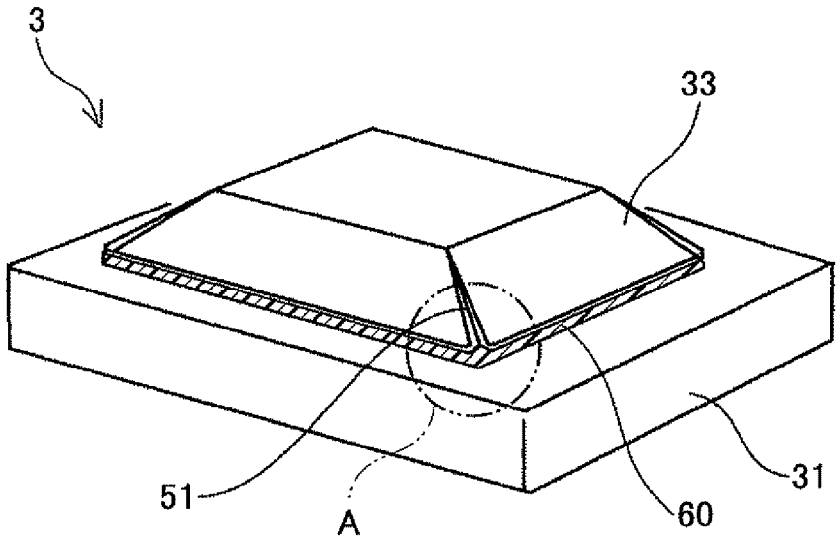
FIG. 11A is a schematic oblique view of the sub tank as a liquid container according to a second embodiment of the present invention.
Figure 11B:
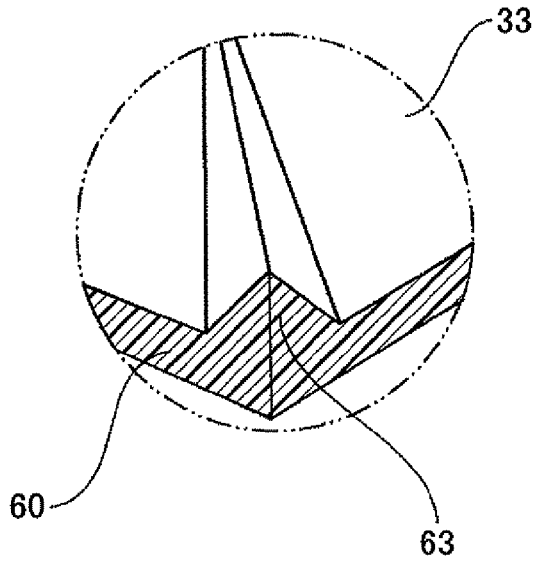
FIG. 11B is an enlarged view of the part marked "A" of FIG. 11A.

FIG. 11A is a schematic oblique view of a sub tank 3 according to a second embodiment of the present invention, and FIG. 11B is an enlarged view of the part marked "A" of FIG. 11A.

In this case, the shape of the opening section of the tank case 31 of the sub tank 3 when viewed from the top of FIG. 11A may be circular or rectangular. When assuming that the shape of the opening section 31*a* is rectangular, by disposing concave sections (or convex sections) 63 at corner sections, the same effect as described in the first embodiment of the present invention may be obtained.

Next, a sub tank as a liquid container according to a third embodiment of the present invention is described with reference to FIGS. 12, 13A, and 13B.

In this embodiment, there is a relationship in which the outer peripheral length of the flexible film 33 that joins with the tank case 31 is the same as the outer peripheral length of the joint section 60 through which the flexible film 33 is joined with the tank case 31. By satisfying the relationship, when the outer circumferential part of the flexible film 33, the part being longer in accordance with the bent part of the flexible film 33, is joined with and fit to the concave-convex structure of the joint section 60, the outer peripheral part of the flexible film 33 may be tightly joined with the concave-convex structure of the joint section 60. As a result, there is no extra outer peripheral portion of the flexible film 33 that cannot be joined with the joint section 60, and regular wrinkles 51 may be formed in a manner such that the positions and the sizes of the regular wrinkles 51 are constant (common) among the sub tanks, thereby enabling obtaining stable negative pressure characteristics.

Figure 12:
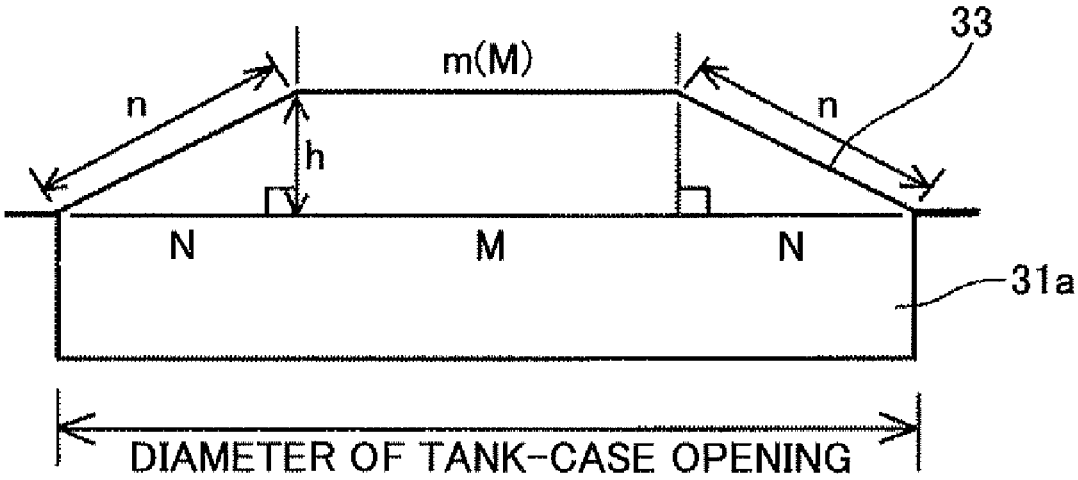
FIG. 12 is a drawing illustrating a feature of a sub tank as a liquid container according to a third embodiment of the present invention.
Figure 13A:
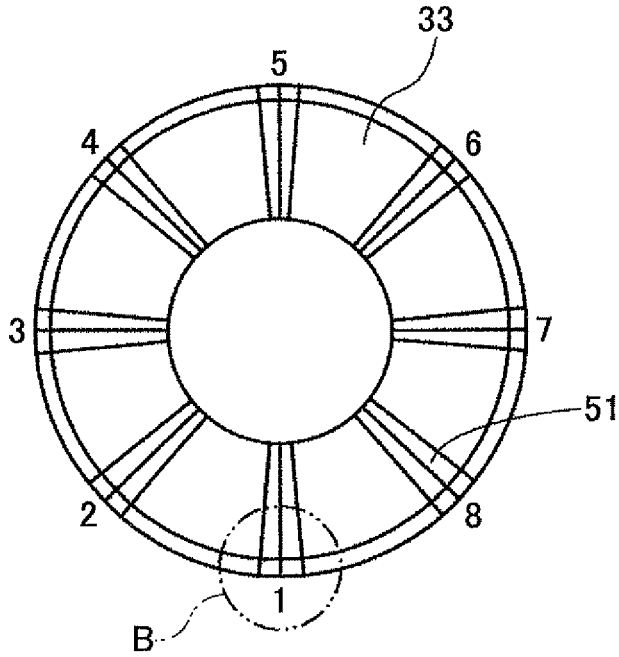
FIG. 13A is a top view illustrating a flexible film of the sub tank.

More specifically, FIG. 12 is a schematic side view illustrating a case where a bent flexible film 33 is joined with the circular joint section 60 of the tank case 31. FIG. 12 illustrates a diameter of the tank-case opening (2N+M) and a length of the flexible film 33 in the diameter direction (2n+m(M)). FIG. 13A illustrates the flexible film 33 joined with the joint section 60 formed on the opening section 31*a* having the opening when viewed from the top. FIG. 13B is an enlarged view of the part marked "B" of FIG. 13A. In this case, there are eight (8) concave parts 61 formed in the circumferential direction of the joint section 60 of the tank case 31.

Herein, when a circumferential length of the joint section 60 through which the flexible film 33 is joined with the tank case 31 (hereinafter referred to as a "circumferential length of tank-case joint section") is given as "L", the following equation is satisfied.

$$L=(\text{“diameter of the tank-case opening}(2N+M)\text{”})\times\pi$$

In this case, the diameter of the tank-case opening is equal to an inner diameter of the joint section 60 where the flexible film 33 is joined. However, as described above, the flexible film 33 is welded while the flexible film 33 is bent. Due to this feature, when a circumferential length of the portion where flexible film 33 is joined with the tank case 31 (hereinafter referred to as "circumferential length of flexible film welded section") is given as "P", the following equation is satisfied.

$$P=(\text{“length of flexible film in diameter direction}(2n+m)\text{”})\times\pi$$

Further, a length of the inclined plane "n" can be obtained based on the height "h" of the bent flexible film 33 and "N" using the following equation.

$$n=\sqrt{((N\times N)+(h\times h))}$$

Further, when an extra part of the flexible film "G" is defined as the difference between the "circumferential length of flexible film welded section (P)" and the "circumferential length of tank-case joint section (L)", the following equation is satisfied.

$$G=P-L$$

In this case, for example, when the number of the concave parts 61 is eight (8), and it is assumed that the all the concave parts 61 (concave-convex structures) have the same shape, the extra part of the flexible film for each concave part 61 is obtained by "G/8".

Figure 13B:
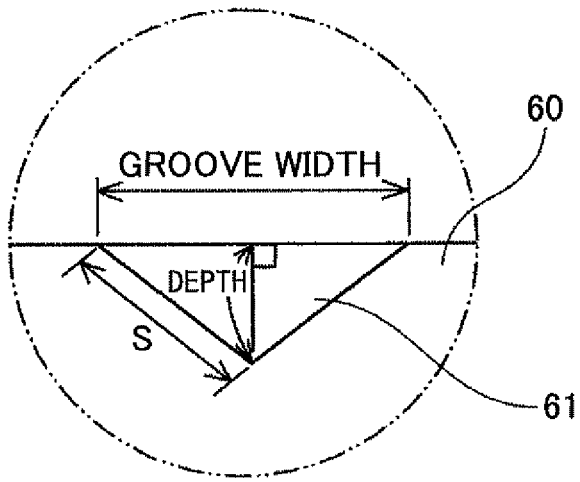
FIG. 13B is an enlarged view of the part marked "B" of FIG. 13A.

As illustrated in FIG. 13B, in a case where the shape of the concave parts 61 (concave-convex structures) is a V-shaped groove, when the groove width and the depth are defined in a manner such that the following equation is satisfied, the "circumferential length of flexible film welded section" and the "circumferential length of tank-case joint section" have the same length.

$$\text{“Inclined plane}(S)\text{”}\times 2=(\text{groove width})+(G/8)$$

By determining the number and the shape of the concave parts 61 (concave-convex structures) so as to satisfy the above equation, it may become possible to use various flexible films having different bent patterns.

Next, a sub tank as a liquid container according to a fourth embodiment of the present invention is described with reference to FIG. 14.

Figure 14:
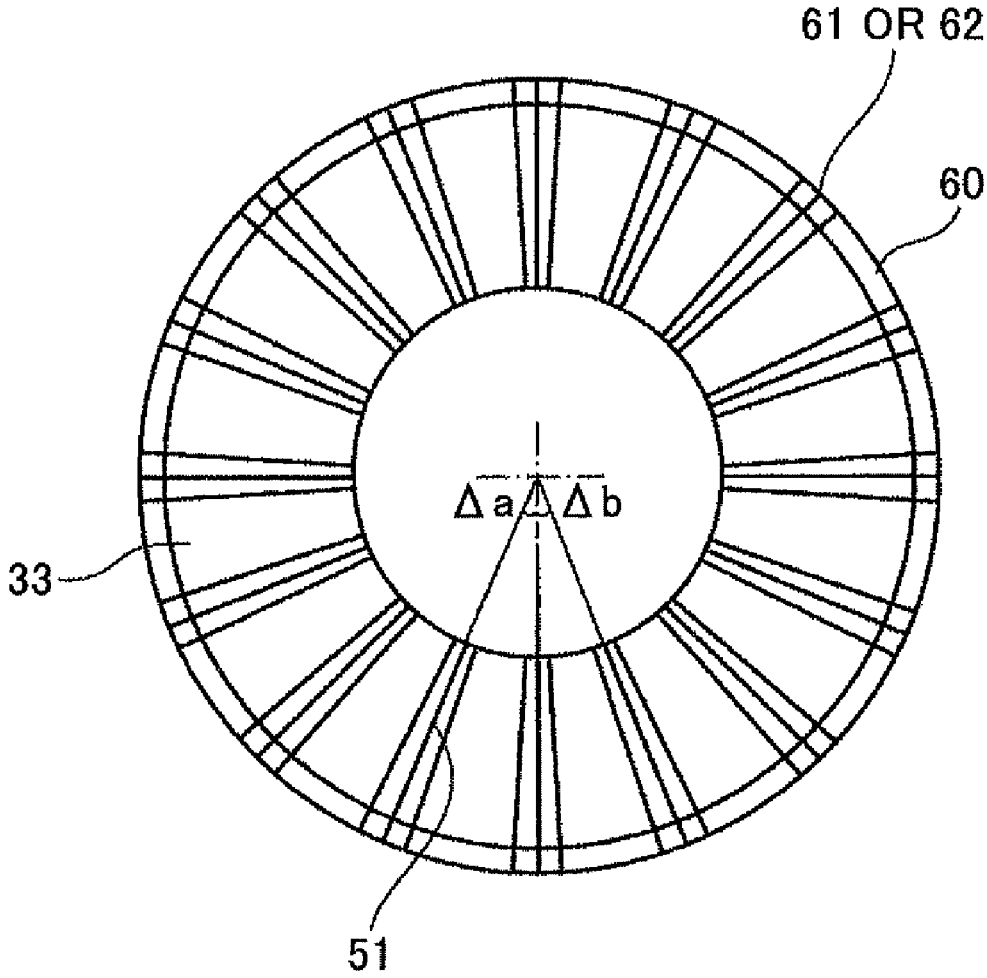
FIG. 14 is a top view illustrating a flexible film of a sub tank as a liquid container according to a fourth embodiment of the present invention.

FIG. 14 is a top view illustrating a flexible film used for the sub tank.

In the flexible film, the concave parts 61 (or convex parts 62) of the joint section 60 through which the flexible film 33 is joined with the tank case 31 are disposed in a manner such that center angles adjacent to each other are the same as each other, the center angle being defined by adjacent two lines (which are the same as the lines of the regular wrinkles 51 in FIG. 14) passing on the center of the flexible film and passing on the center lines of the concave parts 61 (or the convex parts 62) (i.e., $\Delta a=\Delta b$).

By determining the center angles in this way, bent (deformed) portions of the flexible film 33 formed when ink in the sub tank 3 is suctioned or discharged may be apparent at regular intervals. As a result, more stable movement (deformation) of the flexible film may be obtained, thereby stabilizing the negative pressure characteristics.

Next, a sub tank 3 as a liquid container according to a fifth embodiment of the present invention is described with reference to FIGS. 15A and 15B.

Figure 15A:
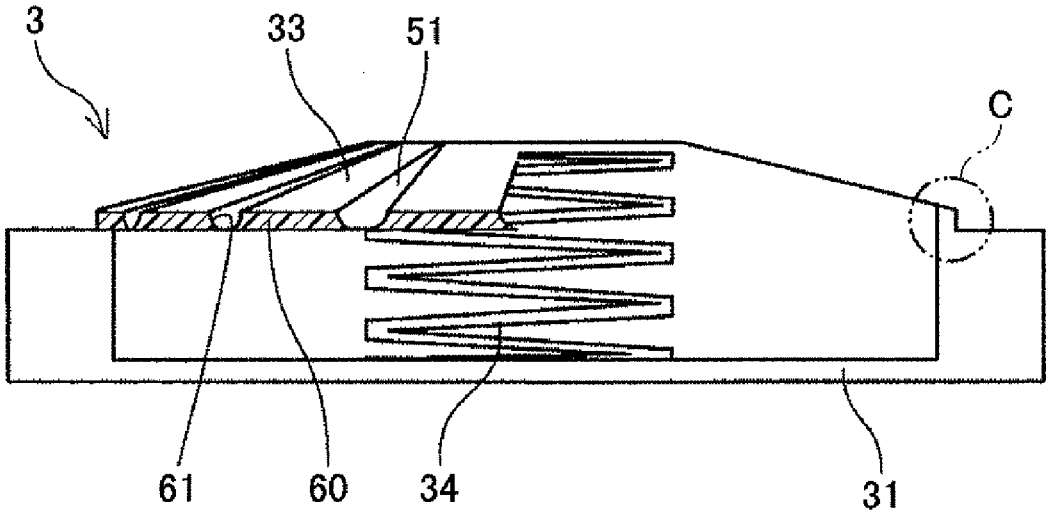
FIG. 15A is a cross-sectional side view illustrating a sub tank as a liquid container according to a fifth embodiment of the present invention.

FIG. 15A is a cross-sectional side view illustrating a flexible film used for the sub tank 3. FIG. 15B is an enlarged view of the part marked "C" of FIG. 15A.

Figure 15B:
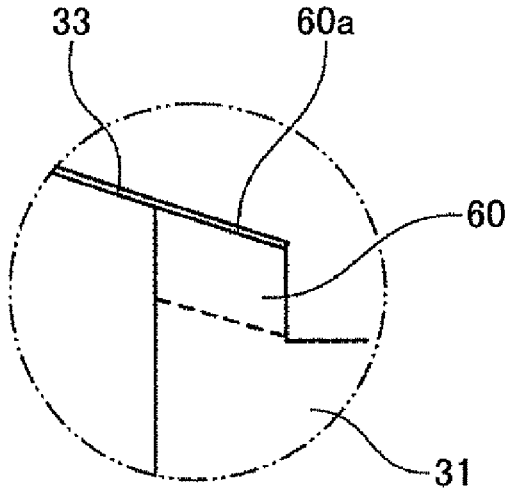
FIG. 15B is an enlarged view of the part marked "C" of FIG. 15A.

As illustrated in FIGS. 15A and 15B, the joint section 60 through which the flexible film 33 is joined with the tank case 31 includes an inclined plane 60*a*. The inclined plane 60*a* becomes lower from the inner circumferential side to the outer circumferential side in the diameter direction of the flexible film 33. The inclined angle of the inclined plane 60*a* is determined in accordance with a bent inclined angle of the flexible film 33.

By having this feature in which the joint section 60 through which the flexible film 33 is joined with the tank case 31 includes the inclined plane 60*a* in accordance with the inclination of the flexible film 33, the regular wrinkles 51 formed due to the concave-convex structure of the joint section 60 in the inclined surface of the flexible film 33 may be joined by means of welding with the tank case 31 without being bent. By preventing the bending of the flexible film 33 on the joint section 60, the regular wrinkles 51 to be formed in the inclined surface of the flexible film 33 may be stably formed, and the flexible film 33 when ink in the sub tank 3 is suctioned or discharged may be stably deformed. As a result, the movement of the flexible film 33 and the negative pressure characteristics in response to the movement of the flexible film 33 may accordingly be stabilized.

Next, a sub tank as a liquid container according to a sixth embodiment of the present invention is described with reference to FIGS. 16A through 16C.

Figure 16A:
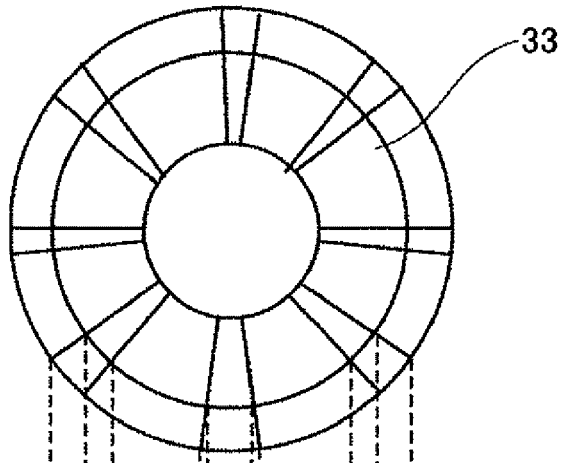
FIG. 16A is a top view illustrating a flexible film of a sub tank as a liquid container according to a sixth embodiment of the present invention.
Figure 16B:
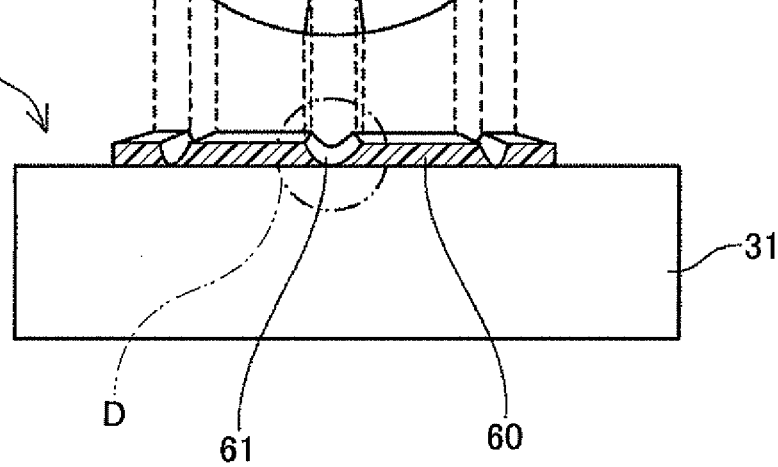
FIG. 16B is a cross-sectional side view illustrating a joint section where the flexible film is to be joined in the sub tank according to the sixth embodiment of the present invention.

FIG. 16A is a top view illustrating a flexible film 33 used for the sub tank 3. FIG. 16B is a cross-sectional side view of the tank case 31 and the joint section 60 formed on the tank case 31 so that the flexible film 33 can be exactly joined with the joint section 60. FIG. 16C is an enlarged view of the part marked "D" of FIG. 16B.

Figure 16C:
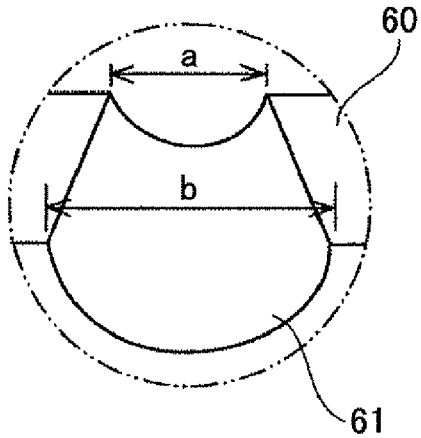
FIG. 16C is an enlarged view of the part marked "D" of FIG. 16B.

In this embodiment, as illustrated in FIG. 16C, in the concave part 61 formed on the joint section 60 of the tank case 31, the inner width "a" is different from the outer width "b". More specifically, a relationship "a<b" is satisfied.

Namely, the concave part 61 formed on the joint section 60 of the tank case 31 is defined by the straight lines extending from the center of the opening section 31*a*. As a result, the bent shape of the concave part 61 is formed as a part of a circular cone having its apex at the position of the center of the opening section 31*a*. Therefore, the concave part 61 is formed in a manner such that the inner width "a" is less (shorter) than the outer width "b", and the outer depth is greater than the inner depth. Because of the concave part 61 formed as descried above, the shape of the regular wrinkles 51 to be formed in the inclined surface of the flexible film 33 may be stably formed without being bent. As a result, the movement of the flexible film 33 and the negative pressure characteristics in response to the movement of the flexible film 33 may accordingly be stabilized.

Figure 17:
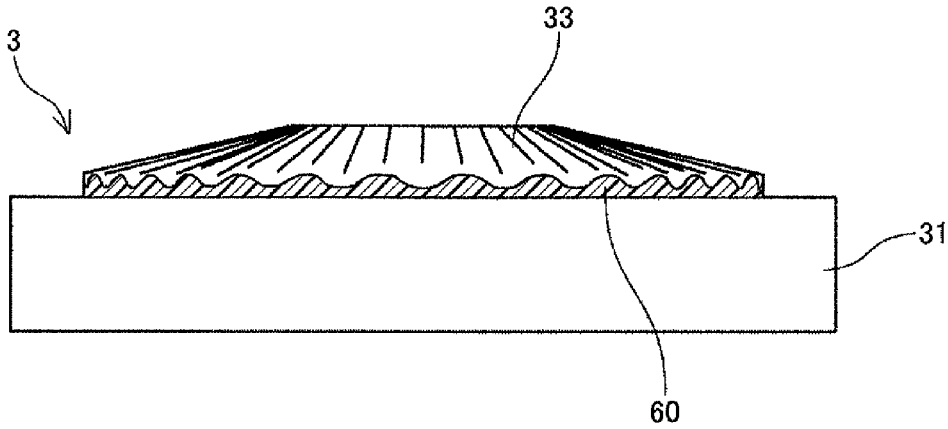
FIG. 17 is a cross-sectional side view illustrating a joint section where the flexible film is to be joined in a sub tank according to a seventh embodiment of the present invention.

Next, a sub tank as a liquid container according to a seventh embodiment of the present invention is described with reference to FIG. 17. FIG. 17 is a cross-sectional side view of the sub tank 3 and the joint section 60.

As shown in FIG. 17, the concave-convex shape on the joint section 60 of the tank case 31 is formed in a sine waveform curve shape in the circumferential direction of the joint section 60 of the tank case 31.

As in this case, when there is no pointed apex at any of the tops of the convex parts and the bottoms of the concave parts, it may become possible to smooth the regular wrinkles 51 formed in the inclined surface of the flexible film 33 that is bent to be welded. As a result, the movement of the flexible film 33 and the negative pressure characteristics in response to the movement of the flexible film 33 may accordingly be stabilized.

Figure 18:
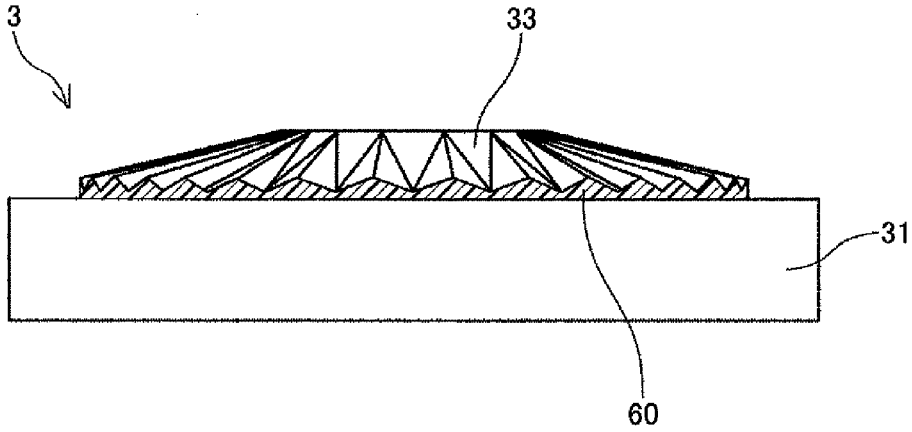
FIG. 18 is a cross-sectional side view illustrating a joint section where the flexible film is to be joined in a sub tank according to an eighth embodiment of the present invention.

Next, a sub tank as a liquid container according to an eighth embodiment of the present invention is described with reference to FIG. 18. FIG. 18 is a cross-sectional side view of the sub tank 3 and the joint section 60.

As shown in FIG. 18, the concave-convex shape on the joint section 60 of the tank case 31 is formed in a sawtooth shape in the circumferential direction of the joint section 60 of the tank case 31.

By forming the concave-convex shape on the joint section 60 in a sawtooth shape in the circumferential direction of the joint section 60 of the tank case 31, it may become easier to manufacture the joint section 60 and it may become possible to reduce the costs.

Figure 19:
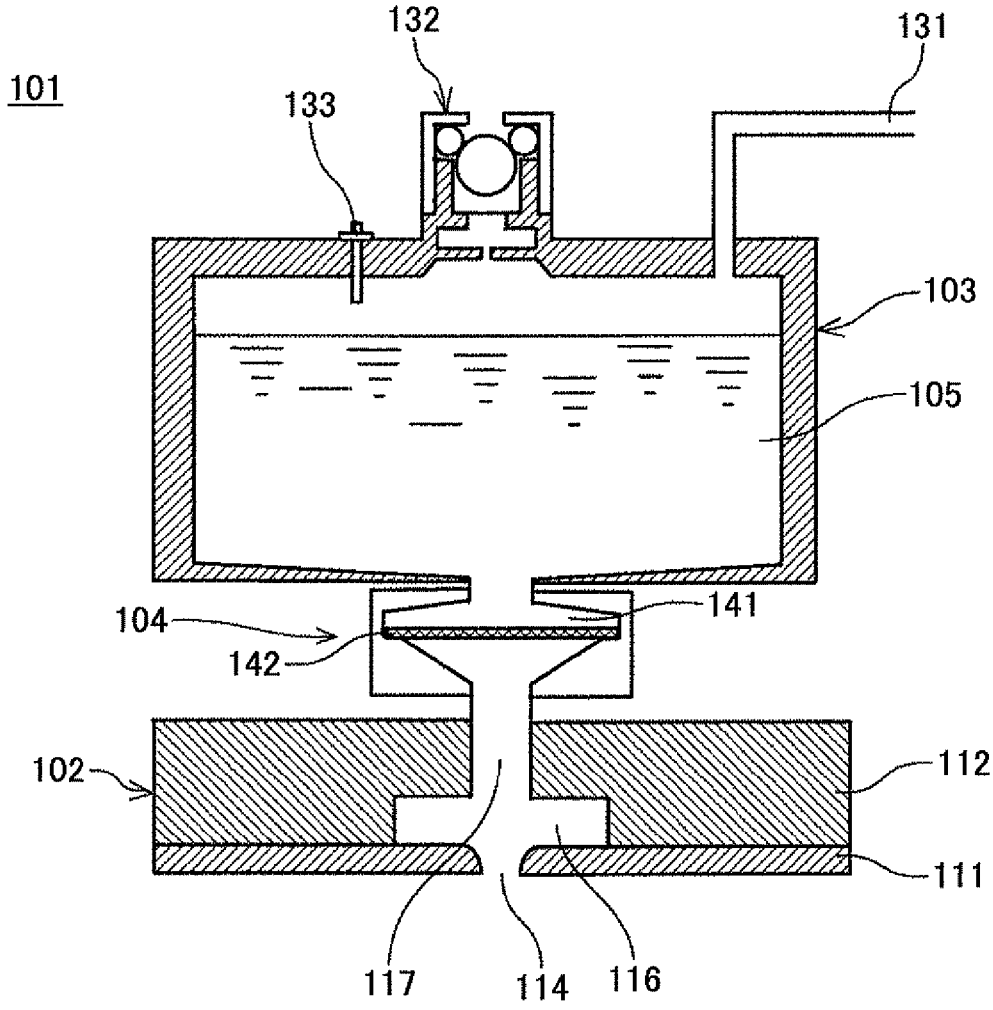
FIG. 19 is a schematic cross-sectional side view illustrating a liquid discharge head unit according to a ninth embodiment of the present invention.

Next, a liquid discharge head unit according to a ninth embodiment of the present invention is described with reference to FIG. 19. FIG. 19 is a schematic cross-sectional side view of the liquid discharge head unit.

As shown in FIG. 19, a liquid discharge head unit 101 includes a liquid discharge head 102, a sub tank 103, and a filter unit 104. The filter unit 104 includes a filter chamber 141 in which a filter 142 is disposed that filters ink supplied from the sub tank 103 to the liquid discharge head 102.

The liquid discharge head 102 includes a flow path plate 112 and a nozzle plate 111 adhered to the flow path plate 112. The nozzle plate 111 forms plural nozzles 114 through which liquid droplets are discharged. Further, the flow path plate 112 forms a liquid chamber 116 in communication with the plural nozzles 114. By using actuator means (not shown), the pressure of ink in the liquid chamber 116 is increased to discharge the liquid (ink) droplets from the nozzles 114. The liquid chamber 116 is in communication with an ink supply path 117 through which ink 105 is supplied via the filter unit 104. As the actuator means (not shown), a piezoelectric actuator, an electrostatic actuator, a thermal actuator or the like may be used.

Ink 105 is externally supplied to the sub tank 103 via a liquid supply opening 131. The sub tank 103 includes an opening mechanism 132 and an ink detection pin 133. The opening mechanism 132 is used to open the inside of the sub tank 103 to atmospheric air. The ink detection pin 133 is used to detect a remaining amount of internal ink.

The filter unit 104 disposed between the sub tank 103 and the liquid discharge head 102 has the filter chamber 141 in a filter case. The filter chamber 141 includes the filter 142 for filtering ink 105 to be supplied to the liquid discharge head 102. As the filter 142, it is preferable to use a sintered body of non-woven metallic fibers or metallic fibers such as SUS fibers.

Figure 20:
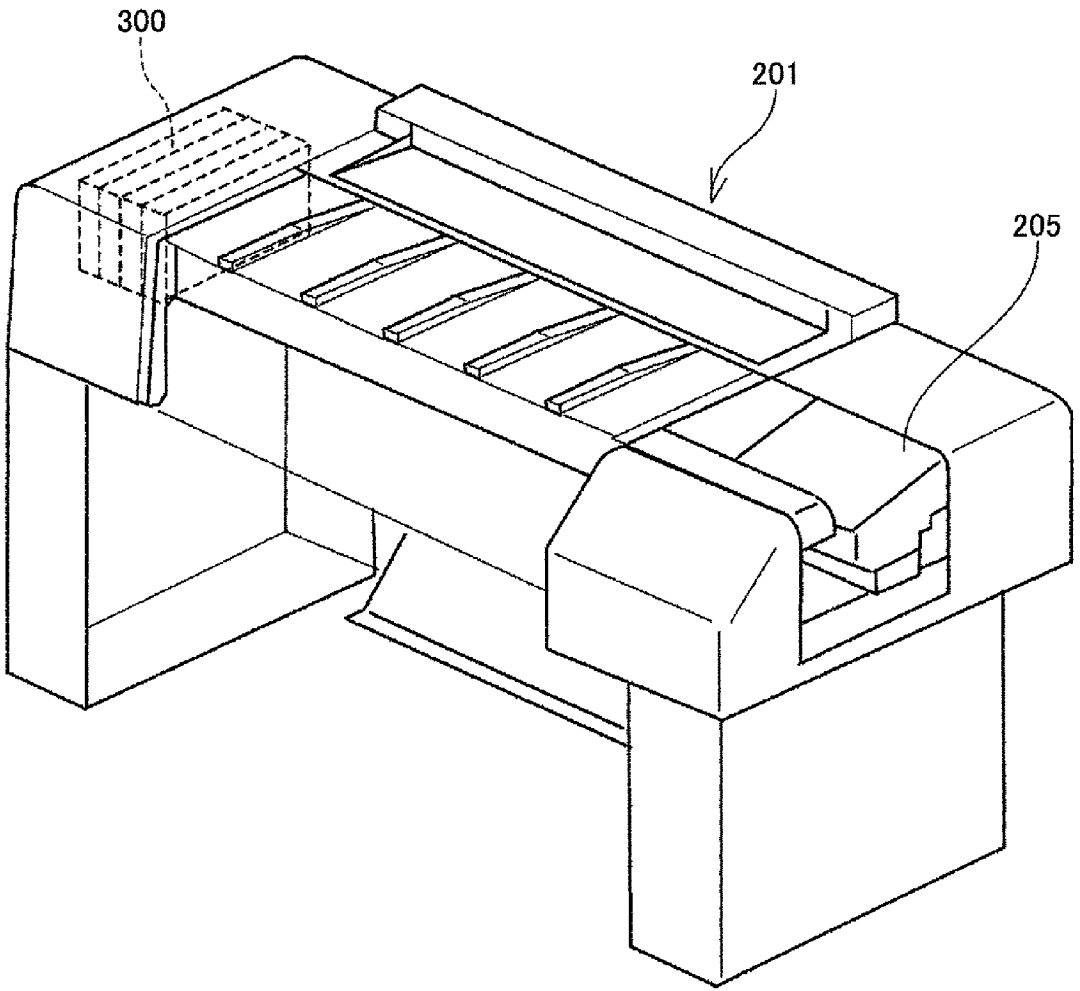
FIG. 20 is a schematic oblique view of an inkjet recording apparatus as an image forming apparatus according to an embodiment of the present invention.
Figure 21:
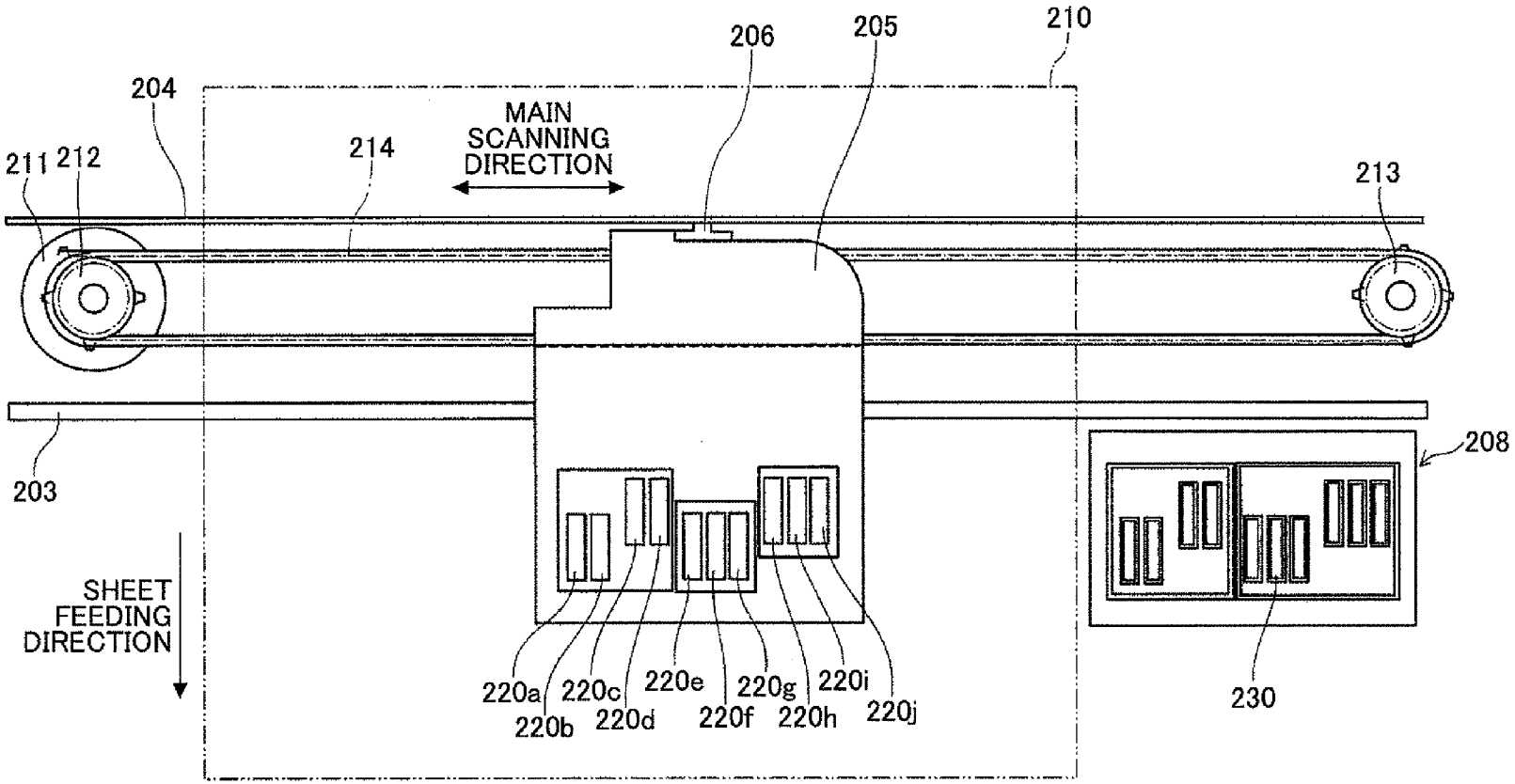
FIG. 21 is a schematic top view illustrating a printing mechanism part of the inkjet recording apparatus of FIG. 20.
Figure 22:
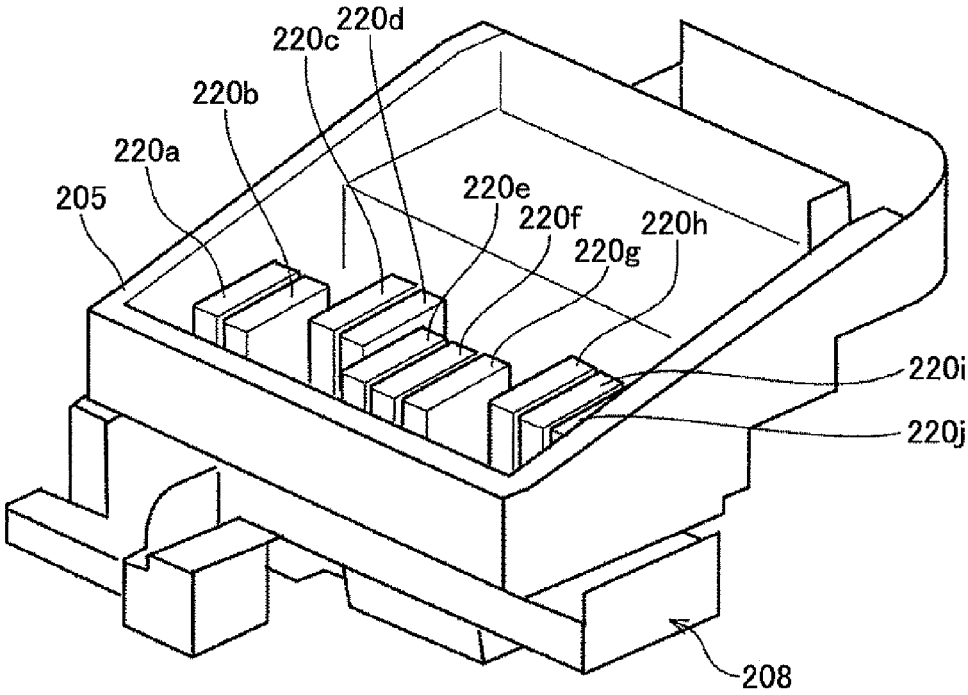
FIG. 22 is a schematic oblique view illustrating a carriage part the inkjet recording apparatus of FIG. 20.

Next, an example of an inkjet recording apparatus as an image forming apparatus having a liquid discharge head unit including a liquid container according to an embodiment of the present invention is described with reference to FIGS. 20 through 22. FIG. 20 is a schematic oblique view of the inkjet recording apparatus. FIG. 21 is a top view illustrating a printing mechanical part of the inkjet recording apparatus. FIG. 22 is a schematic oblique view of a carriage part.

This inkjet recording apparatus is a serial type inkjet recording apparatus. As illustrated in FIGS. 20 and 21, in a recording apparatus main body 201, there are a guide rod 203 and a guide rail 204 bridged between side plates (not shown) on both sides. A carriage 205 is slidably supported in the main scanning direction by the guide rod 203 and the guide rail 204. Further, a sub guide roller 206 is rotatably provided in the rear part of the carriage 205, so that the sub guide roller 206 is in contact with the guide rail 204.

A main scanning mechanism to move and scan the carriage 205 includes a driving motor 211, a driving pulley 212, a driven pulley 213, and a timing belt (belt member) 214. The driving pulley 212 is driven to be rotated by the driving motor 211. The driven pulley 213 is disposed on the other side of the driving pulley 212 in the main scanning direction. The timing belt 214 is stretched between the driving pulley 212 and the driven pulley 213. The driven pulley 213 is biased outward (in the direction to be separated from the driving pulley 212) by a tension spring (not shown).

In this case, the driving pulley 212 and the driven pulley 213 are disposed in a manner such that the pulley axis directions of the driving pulley 212 and the driven pulley 213 extend in the ink discharge direction. Further, a part of the timing belt 214 stretched between the driving pulley 212 and the driven pulley 213 is fixed and supported by a belt fixing section provided on the rear side of the carriage 205. As a result, the timing belt 214 is disposed on one side of the carriage 205 in the direction orthogonal to the main scanning direction.

Further, the carriage 205 includes ten (10) recording heads 220*a* through 220*j* (which may be collectively called "recording heads 220") having the respective buffer tanks (sub tanks). The recording heads 220 are disposed in the head base (not shown). Each of the recording heads 220 has two nozzle rows.

Herein, as illustrated in FIG. 21, a group of the recording heads 220*a* and 220*b* and a group of the recording heads 220*c* and 220*d* are disposed in a zigzag alignment in the sheet feeding direction. For example, those recording heads 220*a* through 220*d* are used as the recording heads discharging black ink droplets. Similarly, a group of the recording heads 220*e* though 220*g* and a group of the recording heads 220*h* through 220*j* are disposed in a zigzag alignment in the sheet feeding direction. In this case, for example, the nozzle rows on one side (right side in the figure) of the recording head 220*e* and 220*h* discharge yellow ink droplets, and the nozzle rows on the other side (left side in the figure) of the recording head 220*e* and 220*h* discharge magenta ink droplets. The nozzle rows on one side (right side in the figure) of the recording head 220*g* and 220*i* discharge magenta ink droplets, and the nozzle rows on the other side (left side in the figure) of the recording head 220*g* and 220*i* discharge yellow ink droplets. The nozzle rows on both sides (right and left sides in the figure) of the recording head 220*f* and 220*i* discharge cyan ink droplets. By allocating color inks in this way, the region of two recording heads in the sheet feeding direction may be printed within a single main scan operation and the order of discharge color inks may become identical in back and forth directions.

On the other hand, in a recording region of the main scanning region of the carriage 205, a sheet 210 is intermittently fed in the direction (sub scanning direction) orthogonal to the main scanning direction by being guided by a platen member of a sheet feeding mechanism (not shown). The platen member is disposed so as to face the recording heads 220 at least in the recording region along the main scanning region of the carriage 205.

Further, in a region on one end side of the main scanning region, a maintenance and recovery mechanism 208 is disposed for maintaining and recovering the recording heads 220. The maintenance and recovery mechanism 208 includes cap members 230 for sealing (capping) the nozzle surfaces of the recording heads 220*a* through 220*j* and a wiper members (not shown) to wipe the nozzle surfaces.

Further, in a region that is on the other side of the main scanning region and that is outside the main scanning region, an ink cartridge (main tank) 300 is removably provided. The ink cartridge (main tank) 300 stores color inks to be provided to the recording heads 220. The ink cartridge (main tank) 300 is in communication with buffer tanks (sub tanks) of the recording heads 200 via tubes.

In this inkjet recording apparatus, while the carriage 205 is moved in the main scanning direction and the sheet 210 is intermittently fed in the sub scanning direction, a predetermined image is formed on the sheet 210 by driving the recording heads 220 and discharging liquid droplets based on the image information.

As described above, the inkjet recording apparatus includes a liquid discharge head unit having a liquid container according to an embodiment of the present invention. Due to the liquid container, stable liquid discharge characteristics may be obtained and a higher-quality image may also be formed.

An image forming apparatus of the present is not limited to an apparatus having a printer function only. For example, the present invention may also be applied to an image forming apparatus having multiple functions including, for example, a printer, a facsimile machine, a copier and the like. Namely, a liquid container according to an embodiment of the present invention may also be applied to such an image forming apparatus.

According to an embodiment of the present invention, a liquid container containing liquid to be supplied to a liquid discharge head includes a container main body defining a liquid containing section and including an opening section formed in one surface of the container main body, the opening section including an opening, and a film-like flexible member sealing the opening section of the container main body. Further, the film-like flexible member is joined with a joint section formed on the opening section of the container main body in a state where the film-like flexible member is bent, and a concave-convex structure is formed in the circumferential direction of the joint section.

Herein, an outer peripheral length of the film-like flexible member may be equal to an outer peripheral length of the joint section.

Further, a shape of the opening may be substantially circular. The concave-convex structure may include plural concave parts and plural convex parts. The center angles adjacent to each other are the same as each other, the center angle being defined by adjacent two lines passing a center of the opening and the centers of the concave parts or the convex parts adjacent to each other.

Further, the joint section may be inclined in accordance of a bending direction of the film-like flexible member.

Further, in the concave-convex structure, a depth of an inner side may be different from the depth of an outer side, or a width of the inner side may be different from the width of the outer side.

Further, a shape of the concave-convex structure in the circumferential direction may be a sine waveform curve shape or a sawtooth shape.

According to an embodiment of the present invention, a liquid discharge head unit includes a liquid discharge head and a liquid container as described above.

According to an embodiment of the present invention, an image forming apparatus includes a liquid container described above or a liquid discharge head unit described above.

In a liquid container according to an embodiment of the present invention, the flexible member is joined with the joint section formed on the opening section of the container main body in a state where the film-like flexible member is bent, and concave-convex structures are formed in the circumferential direction of the joint section. By having this configuration, regular wrinkles are likely to be formed in the film-like flexible member. As a result, due to the regular wrinkles, the film-like flexible member is bent (deformed) stably and stable deformation characteristics of the film-like flexible member may be obtained.

In a liquid discharge head unit according to an embodiment of the present invention, the liquid discharge head unit includes a liquid discharge head and a liquid container according to an embodiment of the present invention. Because of this configuration, the variation of the movement of the flexible member of the liquid container may be reduced, thereby enabling performing stable liquid discharge operations.

In an image forming apparatus according to an embodiment of the present invention, the image forming apparatus includes a liquid container according to an embodiment of the present invention or a liquid discharge head unit according to an embodiment of the present invention. Because of this configuration, the stable liquid droplet discharge may be achieved, and as a result, image quality may be accordingly enhanced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid container containing liquid to be supplied to a liquid discharge head, the liquid container comprising:

a container main body configured to define a liquid containing section and include an opening section formed in one surface of the container main body, the opening section including an opening; and a film-like flexible member configured to seal the opening section of the container main body, wherein the film-like flexible member is joined with a joint section formed on the opening section of the container main body in a state where the film-like flexible member is bent, and a concave-convex structure is formed in the circumferential direction of the joint section.

2. The liquid container according to claim 1, wherein an outer peripheral length of the film-like flexible member to be joined with the container main body is equal to an outer peripheral length of the joint section.

3. The liquid container according to claim 1, wherein a shape of the opening is substantially circular, the concave-convex structure includes plural concave parts and plural convex parts, and center angles adjacent to each other are the same as each other, the center angle being defined by adjacent two lines passing a center of the opening and the centers of the concave parts or the convex parts adjacent to each other.

4. The liquid container according to claim 1, wherein the joint section is inclined in accordance with a bending direction of the film-like flexible member.

5. The liquid container according to claim 1, wherein in the concave-convex structure, at least a depth of an inner side is different from the depth of an outer side and a width of the inner side is different from the width of the outer side.

6. The liquid container according to claim 1, wherein a shape of the concave-convex structure in the circumferential direction is a sine waveform curve shape or a sawtooth shape.

7. A liquid discharge head unit comprising:

a liquid discharge head; and a liquid container according to claim 1.

8. An image forming apparatus comprising:

a liquid discharge head unit according to claim 7.

9. An image forming apparatus comprising:

a liquid container according to claim 1.

* * * * *